United States Patent [19]

Kasama et al.

[11] 4,344,700

[45] Aug. 17, 1982

[54] MECHANISM FOR MOUNTING AND DISMOUNTING A SCREEN-LIKE PHOTOSENSITIVE MEDIUM

[75] Inventors: Nobuhiro Kasama; Tadayuki Kitajima, both of Yokohama, Japan

[73] Assignee: Canon Kabushiki Kaisha, Tokyo, Japan

[21] Appl. No.: 98,762

[22] Filed: Nov. 30, 1979

[30] Foreign Application Priority Data

Dec. 8, 1978 [JP] Japan ..... 53-151763
Dec. 8, 1978 [JP] Japan ..... 53-151766

[51] Int. Cl.[3] ..... G03G 15/00
[52] U.S. Cl. ..... 355/3 SC; 355/30 DR
[58] Field of Search ..... 355/3 R, 3 SC, 3 DR

[56] References Cited

U.S. PATENT DOCUMENTS 3,985,432 10/1976 Hou et al. ..... 355/3 R
4,105,444 8/1978 Shinohara et al. ..... 355/3 SC X
4,165,169 8/1979 Miyashita et al. ..... 355/3 DR

*Primary Examiner*—Fred L. Braun
*Attorney, Agent, or Firm*—Fitzpatrick, Cella, Harper & Scinto

[57] ABSTRACT

A mechanism for mounting and dismounting a screen-like photosensitive medium having a number of fine openings with respect to an apparatus body. It is known to form a screen-like photosensitive medium into the shape of a drum, but according to the present invention, the photosensitive medium and a gear for driving the photosensitive medium are constructed independently of each other to leave the gear on the apparatus body side, and a device for directing a current applied to the photosensitive medium side is provided inside of the gear with a sliding member interposed therebetween. The side surface of the photosensitive medium which corresponds to the gear is provided with a construction similar to the gear portion, thereby facilitating the mounting and dismounting of the screen-like photosensitive medium with respect to the apparatus body.

5 Claims, 15 Drawing Figures

MECHANISM FOR MOUNTING AND DISMOUNTING A SCREEN-LIKE PHOTOSENSITIVE MEDIUM

BACKGROUND OF THE INVENTION

1. Field of the Invention

This invention relates to a mechanism for mounting and dismounting, with respect to an apparatus body, a frame member supporting a screen-like photosensitive medium having a number of fine openings (hereinafter referred to as the screen).

2. Description of the Prior Art

The screen described herein is known from our U.S. Pat. No. 4,143,965 and U.S. Pat. No. 3,680,954. In an apparatus for forming an image by the use of such screen, it has been practised to form the screen into the shape of a drum as disclosed in U.S. Pat. No. 3,985,432. As an example of the means for forming the screen into the shape of a drum, use may be made of a partly cut-away cylindrical frame member 2 as shown in FIG. 1 in the accompanying drawings and the screen 1 may be stretched along the cut-away portion of the frame member 2 and adhesively secured thereto. In FIG. 1, reference character 3 designates cylindrical portions and reference character 4 designates a connection portion. Alternatively, such frame member may be constructed by joining the connecting portion 4 to the cylindrical portions 3. It is very difficult for the frame member 2 to maintain sufficient rigidity because of the limited positional relation between the frame member and a corona discharger disposed therewithin. Also, the screen itself is a net-like member comprising a plurality of very thin layers of several microns to several tens of microns and is structurally weak against extraneous forces.

On the other hand, constituent members such as primary latent image forming means and latent image stabilizing means are disposed around and in proximity to the drum-shaped frame member supporting the screen (hereinafter referred to as the screen drum). Therefore, if a great extraneous force is exerted on the screen drum during the mounting or dismounting thereof with respect to the apparatus body, the frame member may be deformed to thereby twist and damage the screen or deform the configuration of the openings thereof. Also, during the mounting or dismounting, the screen is moved along the rotary center shaft thereof and in that case, there is a danger that the screen is brought into contact with the constituent members around the screen drum, whereby the screen is damaged. Further, it is necessary to dispose a corona discharger within the screen drum and this unavoidably complicates the construction for permitting the internal discharger to be disposed during the mounting or dismounting of the drum.

SUMMARY OF THE INVENTION

It is an object of the present invention to solve the above-noted problems and to provide a construction which facilitates the mounting and dismounting of the screen and of the modulating corona discharger therewithin and which does not impart any undesirable stress to the screen during the mounting or dismounting thereof.

It is a further object of the present invention to provide a construction which can easily set the home position of the screen drum when the drum is mounted on the center shaft.

In connection with the above-described construction, it is an object of the present invention to provide a mechanism for preventing mal-insertion of the modulating corona discharger which is removably mountable with respect to the screen drum.

The present invention which achieves these objects has a photosensitive medium frame member supporting the screen in the form of a drum (screen drum), a rotary center shaft for the screen which is fixed to the apparatus body, a drive unit provided on the rotary center shaft, and a screen drum side supporting unit. The drive unit has drive force transmitting means outside of a rotary bearing member and a fixed portion accompanying electrical wiring inside of the bearing member, and this fixed portion is fixed to the rotary center shaft. That side of the side supporting unit which is opposed to the drive unit has, outside of the rotary bearing member, a portion supporting the screen drum and has a fixed portion accompanying electrical wiring inside of the bearing member, and this fixed portion is slidable with respect to the rotary center shaft during the mounting or dismounting of the drum. The electrical wiring of the drive unit and the electrical wiring of the side supporting unit are connectible or disconnectible by a connector member.

In the above-described construction of the present invention, the drive gear of the drive unit has a projecting portion such as a pin or a recessed portion and by engagement of such projecting or recessed portion with a projecting or recessed portion formed in part of the screen drum, the drum may be rotated. Also, a connector member for supplying power to the power consuming member of the screen drum is disposed on the fixed portion of the drive unit, so that, when the screen drum is dismounted from the rotary center shaft, the screen drum and the drive unit can be electrically divided by the connector member. A position setting projecting portion such as pin or a recessed portion for determining the home position of the screen drum may be provided in the fixed portion of the drive unit.

Further, when it is taken into account to independently remove the power consuming member within the screen drum during the mounting of the drum simultaneously with the dismounting of the drum from the rotary center shaft, and if the connector of the fixed portion of the drive unit is referred to as the first connector member, the power consuming member disposed within the drum and independently removable from the drum may be connected by the second connector member of the drum supporting unit, and the first connector member and the second connector member may preferably be disposed in electrically series relationship to provide an effect which will later be described. The power consuming member may be a modulating corona discharger which may be provided within the drum, or a heating member for heating the screen, or a lamp which may be provided if required.

With the above-described construction, when the screen drum is to be removed from the rotary center shaft, the means for transmitting the drive force to the drum, namely, the drive unit can be left on the center shaft and thus, the weight of the member withdrawn can be reduced. Also, with the construction of the above-described drive portion, the member for supplying the power to the drum side can easily pass through the drive portion and so, the wiring design is not complicated and the safety is enhanced. By providing positioning means on the drive portion left, the home position of the screen can be easily found out and cumbersome adjusting operation can be eliminated. Further, the position is determined by a projecting portion such as a pin or a recessed portion and thus, any electrical member such as microswitch is not required, and a part itself such as a pin or the like supports the member and provides a drive source, thereby enabling effective utilization of the parts.

In the electrical system of the above-described mechanism, the drive portion and the screen drum side are electrically divided by the first connector provided in the drive portion, and the screen drum and the power consuming member therewithin are divided by the second connector, so that these may be easily mounted or dismounted independently of each other and moreover, the connectors are all provided removably in the axial direction, thus providing good operability. That is, the reliability of electrical connection is enhanced by the use of the connector members while, at the same time, removal of individual parts and the mounting of the drum can be accomplished more reliably.

In the construction of the present invention, the drum itself is supported independently of the member therewithin, so that the drum can be removed from its shaft while maintained in mounted condition, thus preventing unnecessary stress from being imparted to the screen.

A safety device for mounting a corona discharger removably mountable with respect to the screen drum in the described manner will be fully explained in the following description.

The invention will become more fully apparent from the following detailed description thereof taken in conjunction with the accompanying drawings.

DESCRIPTION OF THE PREFERRED EMBODIMENTS

The invention will hereinafter be described in greater detail with respect to an embodiment thereof.

Figure 1:
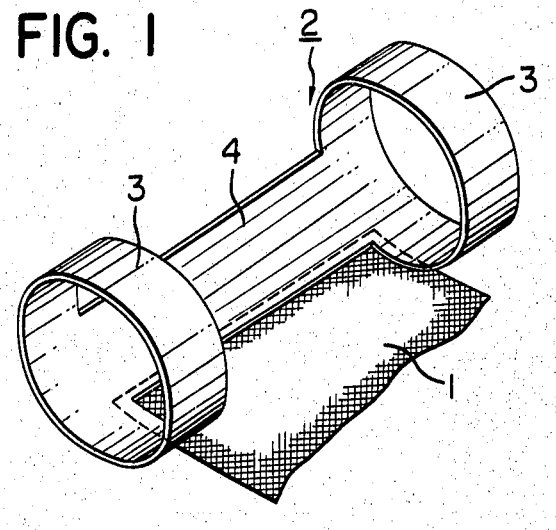
FIG. 1 is a perspective view of a screen drum.
Figure 2:
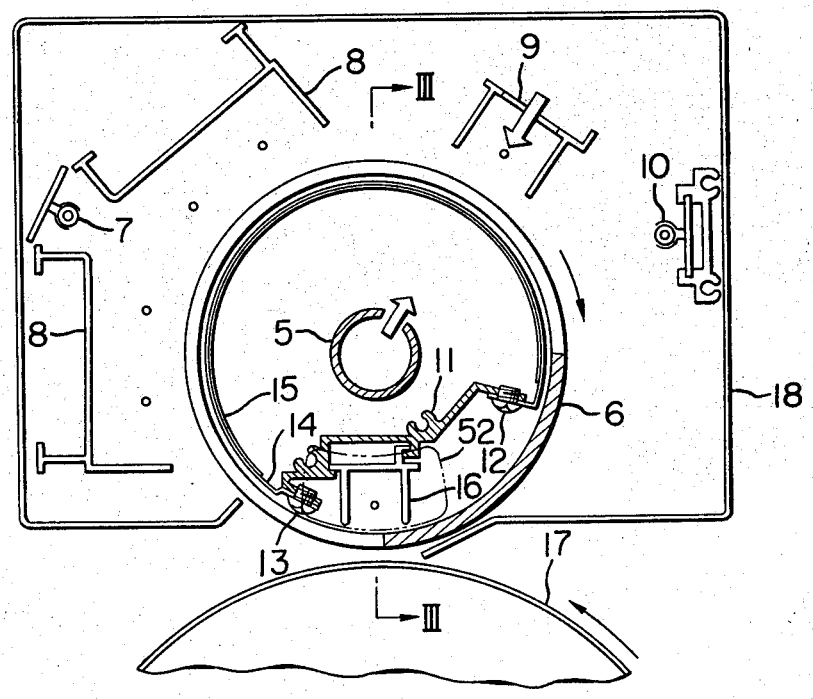
FIG. 2 is a cross-sectional view showing the surrounding of the screen drum in the apparatus according to an embodiment of the present invention.

Referring to FIG. 2 which is a cross-sectional side view showing primary and secondary latent image forming portions of an image formation apparatus to which the present invention is applied, reference character 5 designates a hollow, fixed, rotary center shaft which provides the axis of the rotation of a screen drum 6 having a screen stretched over the outer surface thereof. The screen drum 6 comprises a screen stretched around a frame member 2, shown in FIG. 1, and the screen is a three-layer screen as disclosed in said Japanese Laid-Open Patent Application No. 341/1976. The screen drum 6 is rotated in the direction of arrow and is first subjected to application of light by a lamp 7 and simultaneously therewith, application of corona discharge by a discharger 8, thereby being charged to a predetermined potential. Subsequently, the drum 6 is irradiated with image light and simultaneously therewith, discharged by a corona discharger 9, whereafter it is subjected to uniform application of light by a lamp 10, whereby a primary latent image is formed on the screen.

Within the screen drum 6, there is a stay 11 slidably supported relative to the center shaft 5, and the stay 11 has a cylindrical member 14 fixed at the axial ends thereof by screws 12 and 13. This cylindrical member 14 is concentric with the screen drum 6 and has a surface-like hot plate 15 adhesively secured to the surface thereof which faces the center shaft 5. The surface-like hot plate 15 acts to stabilize the characteristic of the screen when heated and also to prevent the reflected light resulting from the application of light to the screen from affecting the other members than the screen. On the other hand, a corona discharger 16 which is a modulating corona discharger is disposed below the stay 11 and the corona ion flow emitted from the discharger 16 is modulated on an insulating drum 17 rotated in the direction of arrow, correspondingly to the primary latent image on the screen. The above-described latent image formation unit is hermetically surrounded by an outer case 18 and the interior of the case 18 is always maintained at a positive pressure.

As described above, both inside and outside of the screen drum, various members are in proximity to the screen drum. Therefore, the screen is exposed to the high risk of being damaged when the drum is mounted or dismounted with respect to the apparatus body for the purpose of replacement of the screen drum and maintenance of the apparatus. The present invention has solved this problem by a method which will hereinafter be described by reference to FIG. 3 and so on.

Figure 3:
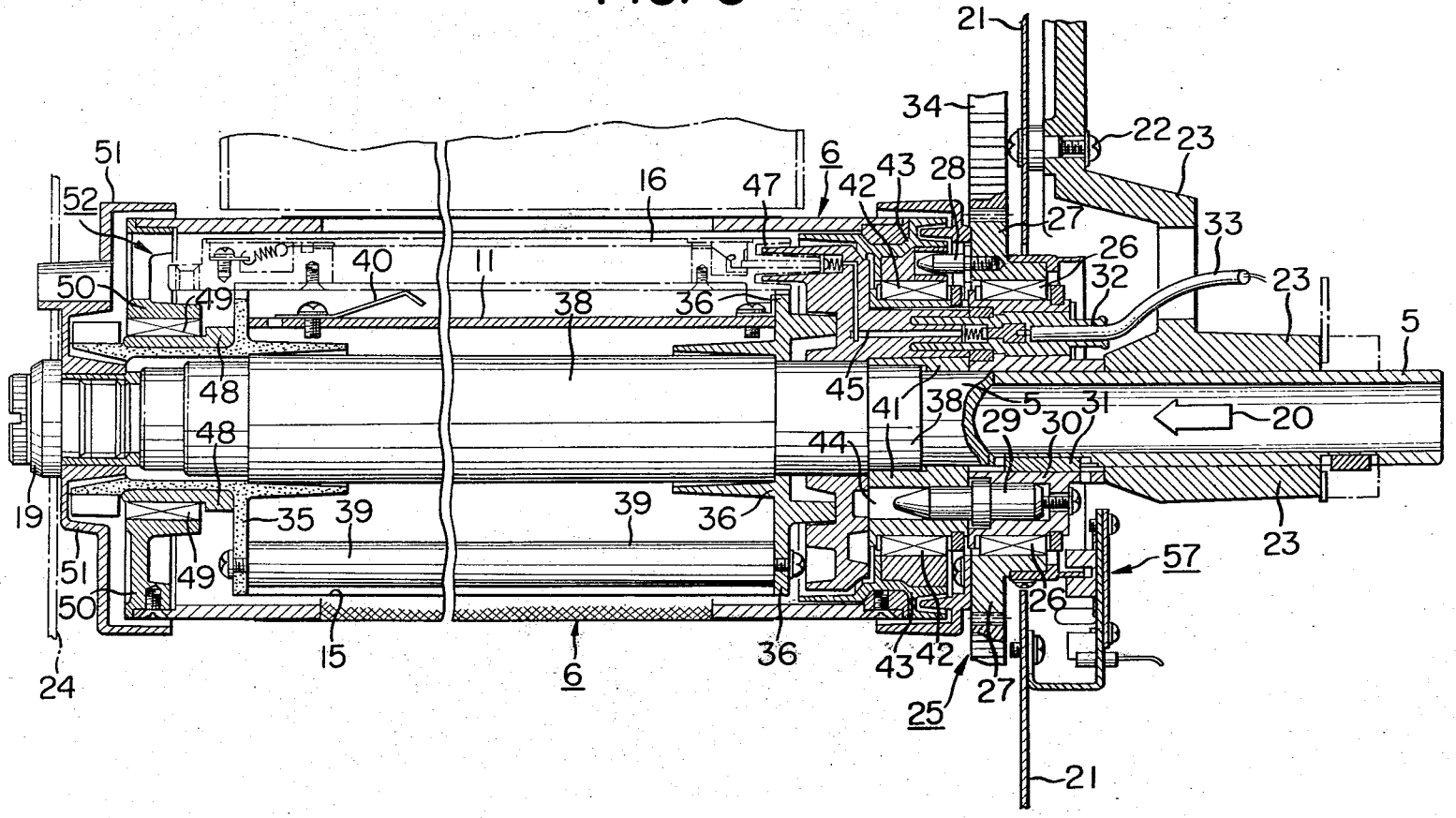
FIG. 3 is a cross-sectional view showing a mounting and dismounting mechanism for the drum.

The screen drum of the present invention is shown in the cross-sectional view of FIG. 3, which is taken along line III—III of FIG. 2. In FIG. 3, the modulating corona discharger 16 and insulating drum 17 of FIG. 2 are depicted by dots-and-dash lines.

In FIG. 3, reference character 5 designates the center shaft. That end of the screen drum at which it may be removed (the left end as viewed in the Figure) is closed by a drum cap 19 which prevents each member on the shaft 5 from being displaced. The other end of the shaft 5 is connected to blower means, not shown, so that compressed air is introduced into the shaft 5 as indicated by arrow 20. The warm wind or the dust-removing wind introduced into the shaft is blown out into the screen drum 6 through a plurality of openings (not shown) provided in the shaft. The blown out air stream reaches the dischargers 8, 9 (FIG. 2) and other members surrounding the drum, through the screen, to heat the screen 1 and prevent the screen from being stained by discharging.

Figure 5:
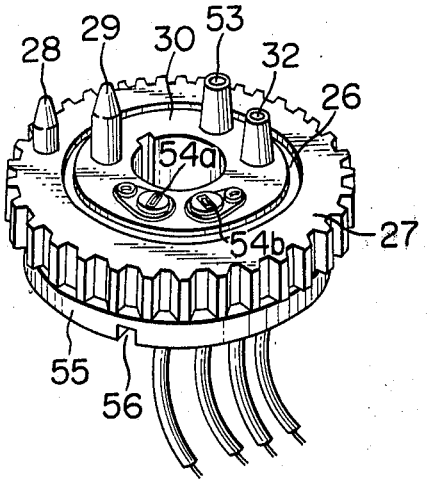
FIG. 5 is a perspective view showing the construction of the drive portion.

The rotary center shaft 5 is secured to the back plate 21 of the apparatus body by a shaft set member 23 secured to the back plate 21 by means of a screw 22. On the other hand, that end of the shaft 5 which is adjacent to a front plate 24 is fixed by a core positioning plate (not shown) removable during the mounting or dismounting of the screen drum 6. On the center shaft, a drive portion 25 for driving the screen drum 6 is provided adjacent to the back plate 21. The drive portion, as shown in FIG. 5, has on the outer side thereof a gear 27 for driving the screen drum through a bearing 26 which is a rotary bearing member, and a drive pin 28 secured to the gear 27 and has on the inner side thereof plug receptacles and a fixed portion 30 to which the positioning pin 29 of the screen drum is secured, and is mounted on the shaft 5 by fixing the fixed portion 30 to the center shaft 5 by means of a pin 31. With the above-described construction, the drive portion can have its fixed portion 30 fixed on the shaft 5 and at the same time can assume a construction in which the drive gear 27 is freely rotatable around the fixed portion. Also, since the fixed portion 30 always assumes a determined position relative to the shaft 5, it is possible to provide a standard pin for positioning the screen drum or to mount plug receptacles. Designated by 32 is a plug receptacle embeded in the fixed portion 30 and supplied with a high voltage current by a cord 33 from a power source section, not shown. On the other hand, a gear 34 meshing with the gear 27 is a drive gear for the insulating drum 17.

The screen drum 6 also removable with respect to the drive portion 25 is of a double drum construction in which the inner drum is formed by the surface-like hot plate 15 which is also supported by the peripheral surface of a front support 35 and a rear support 36, which in turn are supported on an insulative stepped member 38 against axial sliding or rotation relative to the member 38, said stepped member 38 being supported by a stay 39 and provided on the shaft 5. An electrically conductive stay 11 for mounting the modulating corona discharger 16 is supported on the supports 35 and 36, and a plate spring 49 for urging the discharger 16 toward the screen is mounted on the stay 11. The plate spring 40 has applied thereto a bias voltage, and the bias voltage from the stay 11 to the shield plate of the discharger 16 is also applied from here.

The screen drum 6 lies outside of the substantially drum-shaped hot plate 15 and that end of the drum 6 which is adjacent to the back plate is supported by an inner flange 41 provided on the stepped member 38, a bearing 42 provided on the peripheral surface of the flange 41, and a back plate side flange which constitutes a drum side supporting unit comprising an outer flange 43 on the bearing 42. The inner flange 41 has therein an opening 44 fitted over the positioning pin 29, and the outer flange 43 has therein an opening for receiving the drive pin 28. On the other hand, a plug 45 corresponding to the plug receptacle 32 is fitted in the inner flange and when the screen drum is mounted, this plug is electrically connected as shown in FIG. 3. This will hereinafter be referred to as a first connector.

An intermediate member 46 constituting a second connector is supported on the stepped member 38 between the back plate side flange and the support 36. This intermediate member is formed of an insulating material, and a plug receptacle 47 into which the plug of the corona discharger 16 side may be inserted is provided at the opposite side from the plug 45.

The front plate side of the screen drum is supported by an electrically conductive wheel member 48 provided on said support 35, a bearing 49 on the peripheral surface thereof, and a front plate side flange comprising an outer flange 50 provided on the peripheral surface of the bearing 49. Application of a bias voltage to the screen drum is effected from the stay 11 through the wheel member 48 and the bearing 49 using electrically conductive grease and through the flange 50. That portion of the back plate side flange which is in contact with the drum 6 is formed of an insulating material to prevent the bias current from flowing to the apparatus body side.

Figure 4:
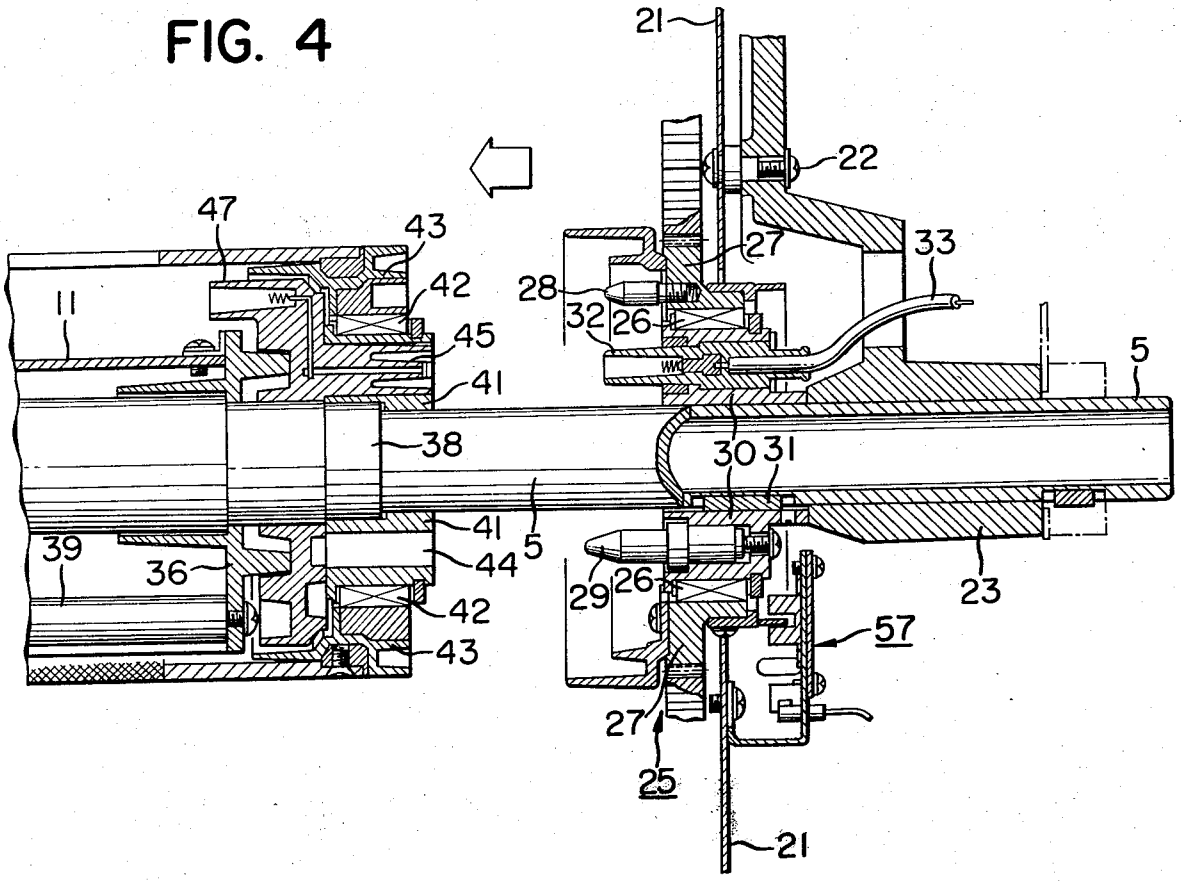
FIG. 4 is a fragmentary cross-sectional view of the same mechanism.

To remove the discharger 16 in the above-described construction, the drum cap 19 may be removed and a flange 51 may be removed, and then the plug of the discharger may be axially withdrawn from the plug receptacle 47 through an opening 52 in the flange 50, whereby the discharger may be singly removed. To remove the entire drum 6 from the drive portion, the drum cap 19 may be removed and a shaft having the same diameter as that of the shaft 5 may be connected to the cap portion, and then the entire drum may be forced leftwardly as viewed in the Figure, whereby the drum 6 may slide on the shaft 5 with the stepped member 38 to assume a position as shown in FIG. 4. Mounting the screen drum 6 on the apparatus body may be easily and smoothly accomplished by carrying out procedures reverse to the aforementioned procedures. During the dismounting of the screen drum, the drum can be withdrawn outwardly in this manner as it is in mounted condition and this enables the presence of damages or wrinkles on the screen to be readily and fully checked up.

Referring to FIG. 5 which shows the members constituting the above-described drive portion, reference character 53 designates a bias voltage connector for the shield plate of the discharger 16 and the drum 6, and reference characters **54*a* and 54*b* designate connectors for the surface-like hot plate 15**. Each connector has a construction which permits the screen drum side plug to mesh therewith reasonably during the mounting of the drum.

The above-described construction enables bias application to the complicated screen drum, corona discharger and other members to be effected reliably and stably and further enables each member to be readily mounted or dismounted with respect to the drum drive portion and moreover, during the mounting, the home position of the drum can be easily found with the aid of the pin member, thus eliminating any cumbersome adjustment.

In FIG. 5, a recess formed in a flange 55 is for detecting the position of the screen drum. Such recess is detected by the detecting portion 57 of FIG. 3 and used to control the operation of image formation means, not shown. The aforementioned positioning pin may be provided on the screen drum and a pin may be provided on the drive portion and a recess may be formed in the drum 6.

Description will now be made of a mounting safety device for the modulating corona discharger which is removably mountable with respect to the screen drum 6.

The modulating corona discharger 16 may be removed or mounted with respect to the screen drum 6 even when the drum 6 is or is not supported on the rotary center shaft 5. The purpose of removal of the discharger is to clean or replace the discharger and when the discharger is again inserted into the screen drum 6, it must be reliably and fixedly disposed at its accurate position. The reason is that in an image formation apparatus using such a screen, the screen drum 6 is rotated but the discharger 16 is fixedly disposed at a perdetermined position within the screen drum 6 and therefore, if the discharger 16 is not completely inserted into the predetermned position, it will strike against the drum side flange portion which is rotated with the screen 1. Thereby, the screen 1 which is usually made up with a thickness of several tens of microns will be twisted with the screen drum 6, thus being damaged. A first example for solving this problem will be described by reference to FIG. 6.

Figure 6:
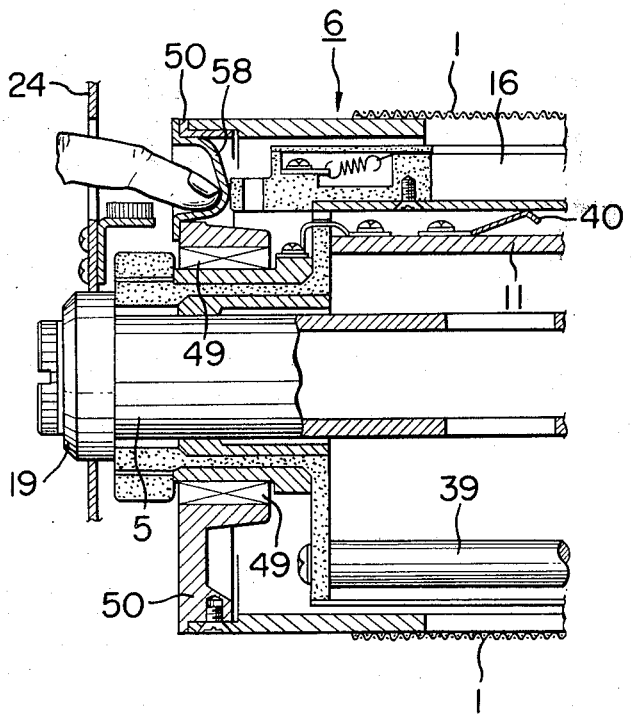
FIG. 6 is a fragmentary cross-sectional view of the apparatus illustrating the manner of mounting a modulating discharger.

FIG. 6 is a cross-sectional view showing the interior of the screen drum 6 with the discharger 16 inserted thereinto. After the discharger 16 has been deeply pushed into its shown position (rightwardly as viewed in the Figure), a mal-insertion preventing lid 58 is fitted into the opening 52 (see FIGS. 2 and 3) of the outer flange 50 of the screen drum 6 by a finger or the like. In this case, the mal-insertion preventing lid 58 is elastically deformed toward the interior of the screen drum 6, thus forcing the discharger 16 into its predetermined accurate position. Then, when the finger is released, the mal-insertion preventing lid 58 restores its original configuration and comes off the end face of the discharger 16, so that even if the screen drum 6 is rotated, the screen 1 and other members forming the screen drum 6 may be protected from any damage which would otherwise result from insufficient insertion of the discharger 16, thus precluding occurrence of any accident.

Figure 7:
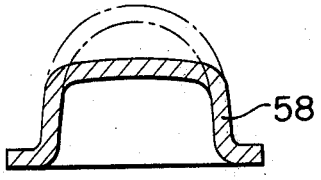
FIG. 7 is a cross-sectional view of a lid.
Figure 8:
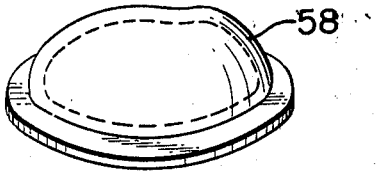
FIG. 8 is a perspective view of the same lid.

FIGS. 7 and 8 are a cross-sectional view and a perspective view, respectively, showing an example of such mal-insertion preventing lid 58 which is formed of rubber. In FIG. 7, the portion depicted by dot-and-dash lines shows the range of the lid 58 which can be elastically deformed by pushing it by a finger.

With such a construction, it is possible to eliminate leakage of wind from the opening 52 of the flange 50 of the screen drum by the mal-insertion preventing lid 58 when the wind is blown into the screen drum 6 through the interior of the rotary center shaft 5 to prevent adherence of dust or toner to the screen 1 or to prevent production of impurities and thus, the interior of the drum is substantially hermetically sealed to enable the wind to be blown into the screen 1 further efficiently. During the downtime of the apparatus, it is often the case that the wind is not blown into the screen drum and the presence of the opening allows suspended toner or dust to enter the interior of the drum and adhere to the discharger 16 and/or the screen 1, but again in such case, the mal-insertion preventing lid 58 is effective to prevent such entry and adherence of the toner or dust.

Another embodiment of the mal-insertion preventing mechanism will now be described in detail.

Figure 9:
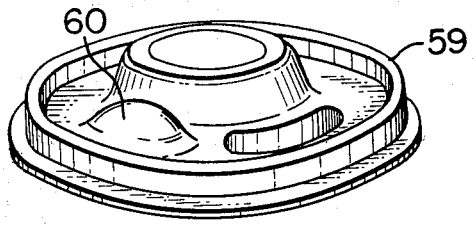
FIG. 9 is a perspective view of a flange.
Figure 10:
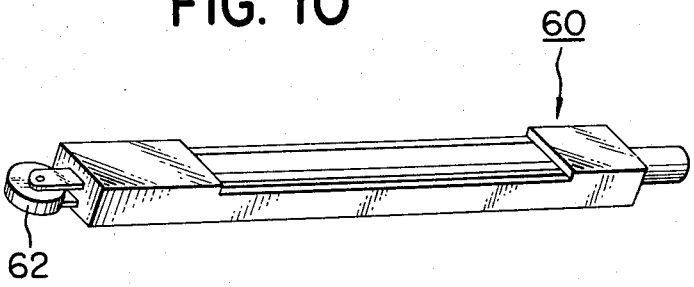
FIG. 10 is a perspective view of the corona discharger.
Figure 11:
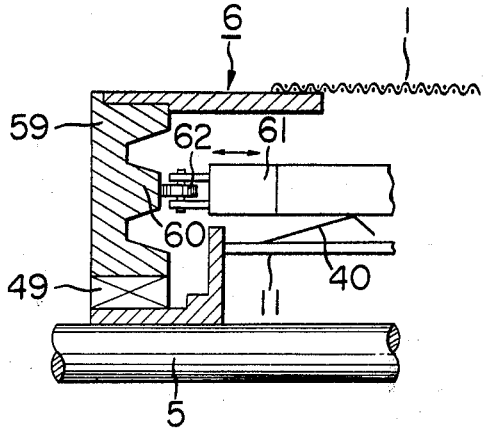
FIGS. 11 to 15 are fragmentary cross-sectional views of the apparatus illustrating the manner of mounting the modulating discharger.

FIG. 9 is a perspective view showing a flange different in configuration from the flange 50, FIG. 10 is a perspective view showing the configuration of a discharger for this embodiment, and FIG. 11 is a fragmentary cross-sectional view showing the engagement relationship therebetween. A flange 59 is formed with a sloping-surfaced projecting portion 60 which may contact a roller 62 attached to the end of a modulating discharger 61 shown in FIG. 9. At this time, even if the discharger 61 is not in completely inserted condition, the projecting portion 60 forming the sloping surface acts to insert the discharger 61 completely deeply when the drum 6 is rotated with the flange 59. After that, the projecting portion 60 of the flange and the roller 62 of the discharger are brought into non-contact relationship.

Figure 12:
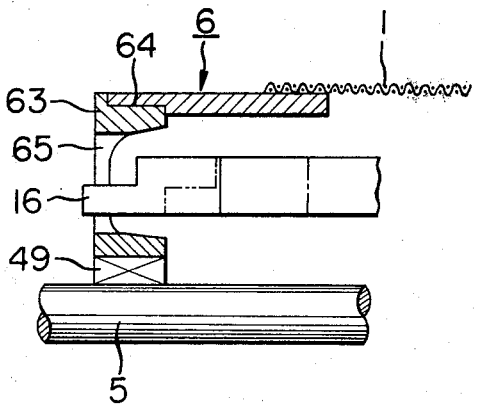

Reference is now had to FIG. 12 to describe a third embodiment.

In this embodiment, a sliding portion 64 facing the screen drum 6 and the flange 63 is slidably constructed so that, even if the discharger 16 is not fully deeply inserted into the screen drum 6 and is projected from the opening 65 of the flange 63, only the drum 6 continues to rotate due to the presence of the sliding portion 64, whereby the screen drum 6 may be prevented from being damaged. In FIG. 12, the position indicated by broken line is the regular position of the discharger 16.

Figure 13:
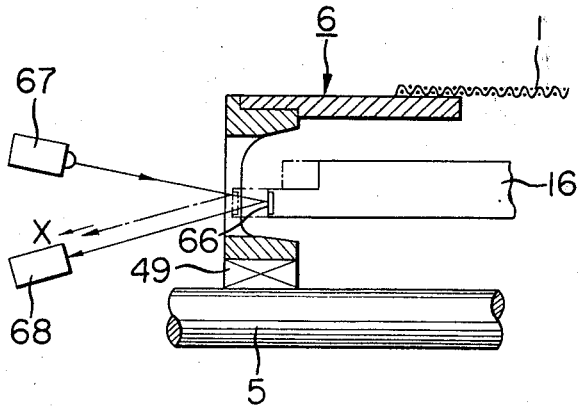

A fourth embodiment will now be described with reference to FIG. 13.

A reflecting surface 66 is formed on a part of the end of the discharger 16 so that, when the discharger 16 is disposed at its regular position, the light from a light source 67 may be reflected by the reflecting surface 66 and enter a light-receiving portion 68 and that when the discharger 16 is not at its regular position, the light may not enter a predetermined position of the light-receiving portion 68 and that when the discharger is not at its predetermined position, a current may not flow to a drive source such as a motor for driving the screen drum 6, thereby preventing occurrence of any accident which would otherwise result from mal-insertion of the discharger 16.

Instead of reflection of light, reflection of ultrasonic wave or other may of course be utilized.

Figure 14:
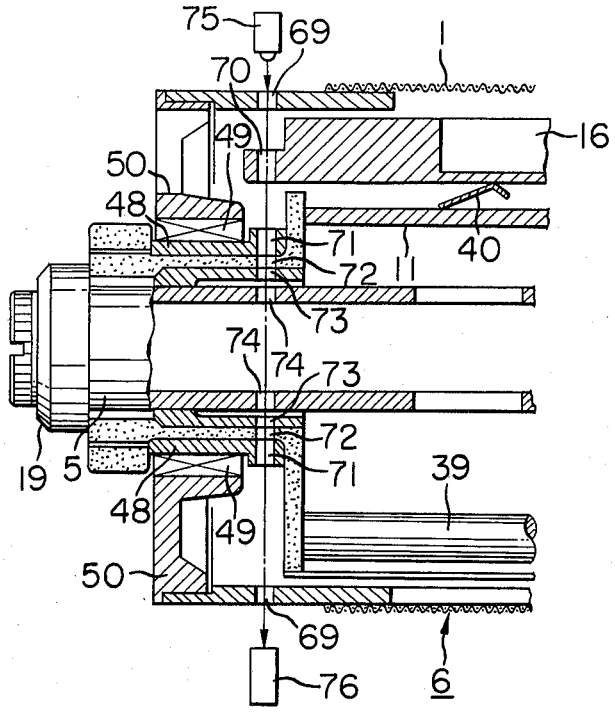
Figure 15:
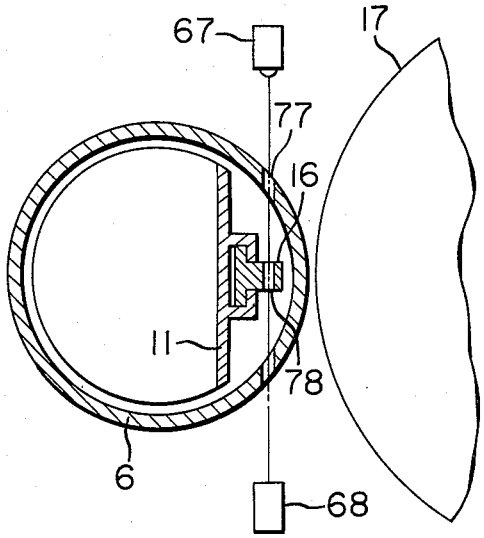

Reference is now had to FIGS. 14 and 15 to describe a fifth embodiment.

Apertures 69, 70, 71, 72, 73 and 74 are formed through the screen drum 6, the discharger 16, the electrically conductive wheel member 48, the support 35 and the rotary center shaft 5 and these apertures are substantially in line with one another when the screen drum 6 is at its basic stop position. When the light from a light source 75 does not pass to a light-receiving portion 76, the motor or the like for driving the screen drum 6 is not rotated. Thus, when the discharger 16 is not at its regular position, namely, when the discharger 16 is mal-inserted, the screen drum 6 is not rotated and no damage occur to the screen 1. Each of the aforementioned apertures for passage of light may preferably be sealed by a transparent material to provide a dust-proof effect.

Since a high bias voltage necessary during the modulation is applied to the interior of the screen drum 6, using an ordinary microswitch to prevent mal-insertion of the discharger 16 would be very dangerous in causing malfunctioning or leak and would also be difficult to do and therefore, the detection by non-contact as in the present embodiment may be said to be preferable. Also, a modification as shown in FIG. 15 would occur to mind. That is, it is possible to provide a practical type of construction in which apertures 77 and 78 are formed through part of the screen drum 6 and discharger 16.

With the above-described construction, mal-insertion of the discharger may be simply prevented and any damage to the screen may be eliminated while, at the same time, escape of the blast from the interior of the screen drum and entry of dust or the like into the drum may also be prevented, thereby achieving the aforementioned objects. Thus, the present invention is highly useful.

What we claim is:

1. A construction for enabling a screen-like photosensitive medium, having a number of fine passage openings, to be removably mounted with respect to an apparatus body, comprising:

a photosensitive medium frame member for supporting said photosensitive medium in the form of a drum;

a rotary center shaft for providing the center of rotation of said photosensitive medium frame member, said shaft being rotatably fixed at one end to the apparatus body;

a drive unit mounted adjacent the fixed end of said rotary center shaft;

a frame member side supporting unit for supporting that side of said photosensitive medium frame member which is adjacent to said drive unit, with respect to said rotary center shaft;

an electrical power consuming element provided inside of said photosensitive medium frame member; and power source means, coupled to said power consuming element, provided on the apparatus body side;

said drive unit having a rotary bearing member, drive force transmitting means disposed radially outward of said rotary bearing member, and a fixed portion for carrying electrical wiring inside of the bearing member, said fixed portion being fixed on said rotary center shaft, said frame member side supporting unit having, outside of the rotary bearing member, a portion for supporting said photosensitive medium frame member and having a fixed portion for carrying electrical wiring disposed inside of said bearing member, said latter fixed portion lying on said rotary center shaft and being slidable relative to said center shaft, said electrical wiring on said drive unit side and said electrical wiring on said side supporting unit side having removable contacts, whereby when said photosensitive medium supporting member is mounted or dismounted with respect to the apparatus body, said power source portion on the body side and said power consuming portion on said supporting member side are connected or disconnected by said contacts.

2. The construction according to claim 1, wherein said power consuming element disposed within said photosensitive medium frame member is a corona discharger which is fixedly mounted within the frame member.

3. The construction according to claim 2, wherein said corona discharger is removably mountable with respect to said photosensitive medium frame member.

4. The construction according to claim 1, wherein the driving of said photosensitive medium frame member is effected by mechanical connection between said drive force transmitting means on said drive unit side and said frame member supporting portion on said side supporting unit side.

5. The construction according to claim 1, wherein said power consuming element disposed within said photosensitive medium is a heater for heating said screen-like photosensitive medium, said heater being fixedly mounted within said frame member.

* * * * *